US010874272B2

(12) United States Patent
Storti, Jr.

(10) Patent No.: US 10,874,272 B2
(45) Date of Patent: Dec. 29, 2020

(54) DUAL ACTION PIVOTING VACUUM CLEANER ACCESSORY

(71) Applicant: Raymond P. Storti, Jr., Bloomington, IL (US)

(72) Inventor: Raymond P. Storti, Jr., Bloomington, IL (US)

( * ) Notice: Subject to any disclaimer, the term of this patent is extended or adjusted under 35 U.S.C. 154(b) by 326 days.

(21) Appl. No.: 16/168,334

(22) Filed: Oct. 23, 2018

(65) Prior Publication Data

US 2019/0117029 A1 Apr. 25, 2019

Related U.S. Application Data

(60) Provisional application No. 62/575,784, filed on Oct. 23, 2017.

(51) Int. Cl.
*A47L 9/06* (2006.01)
*A47L 9/24* (2006.01)

(52) U.S. Cl.
CPC ..... *A47L 9/0693* (2013.01); *A47L 9/062* (2013.01); *A47L 9/242* (2013.01)

(58) Field of Classification Search
CPC ..... A47L 9/0693; A47L 9/242; A47L 9/062
See application file for complete search history.

(56) References Cited

U.S. PATENT DOCUMENTS

2006/0157973 A1* 7/2006 Rissik ..... E04H 4/1636 285/179
2009/0188067 A1* 7/2009 White ..... A47L 9/242 15/246.2
2011/0023262 A1* 2/2011 Conrad ..... A47L 5/225 15/361
2017/0215669 A1* 8/2017 O'Neill ..... A47L 9/02

* cited by examiner

*Primary Examiner* — David Redding
(74) *Attorney, Agent, or Firm* — Law Office of Gerard F. Dunne; Gerard F. Dunne

(57) ABSTRACT

A detachable 90 degree pivoting elbow forming an air channel that connects to a cleaning element permitting a swivel connection in orthogonal directions to provide a connection to the free end of an elongate wand of a vacuum cleaning system.

2 Claims, 4 Drawing Sheets

DUAL ACTION PIVOTING VACUUM CLEANER ACCESSORY

CROSS REFERENCE TO RELATED APPLICATIONS

Another objective of the present invention is to allow the cleaning accessory to pivot in more than one plane relative the surface to be cleaned to improve accessibility for contact with the object to be cleaned. Additionally, an object of the present invention is to allow a cleaning accessory to pivot to allow travel into corners where a horizontal and vertical surface meet, or upon uneven surfaces, without needing to reposition the elongate wand or the operator.

FIELD OF THE INVENTION

The present invention relates to a cleaning accessory for a vacuum cleaner that can pivot in two orthogonal directions enabling a wide range of motion for the accessory.

BACKGROUND OF THE INVENTION

Vacuum cleaners often have an elongate wand that conveys the suction applied by the vacuum cleaner and perhaps power to a cleaning accessory that may typically include a brush or other cleaning element attached to the end portion of the wand. Often such cleaning accessories that are attached to an end portion of such wands need to be located upon elevated surfaces in many industrial and commercial spaces; and such surfaces may be curved such as typically found on duct work, or have an angled or uneven surface.

Often ladders or other objects needed to extend or alter the reach of the operator may be difficult to fit in some confined areas, or complicate the cleaning tasks. Surfaces to be cleaned my often be vertical, horizontal, curved, and positioned for limited access often requiring the operator to change positions or relocate when making use of conventional cleaning accessories. Such problems result in the cleaning operation becoming difficult or unduly time consuming. When cleaning overhead, the task is often further complicated by the traditional geometry of the wand connection to the cleaning tool; especially when attempting to clean rounded or uneven surfaces.

Cleaning accessories to be attached to an extended wand of a vacuum cleaner are well known, for example, as described in U.S. Pat. No. 4,270,238 illustrating a cleaning head pivotal in a horizontal plane and U.S. Pat. No. 4,397,060 illustrating a cleaning head pivotal in a vertical plane. However, in cleaning floor surfaces, the traditional push and pull motion associated with tools designed in the horizontal plane is ideal for some spaces but is disadvantaged in other spaces where a tool in the vertical plane would be more appropriate; and vice versa.

It is, therefore an object of the present invention to provide a vacuum cleaning accessory permitting effective cleaning of elevated curved, horizontal and vertical surfaces as well as hard floor and carpeted floor surfaces by being pivotal in orthogonal planes.

Another objective of the present invention is to allow the cleaning accessory to pivot in more than one plane relative the surface to be cleaned to improve accessibility for contact with the object to be cleaned. Additionally, an object of the present invention is to allow the a cleaning accessory to pivot to allow travel into corners where a horizontal and vertical surface meet, or upon uneven surfaces, without needing to reposition the elongate wand or the operator.

Another object of the present invention is to address the need for a cleaning accessory to be pivotal relative to the extended wand to be able to be positioned to some surfaces on a horizontal plane and in an other cases in a vertical plane for effective surface contact without the need for the operator to be repositioned.

Another object of the present invention is to provide a cleaning accessory to meet the objectives noted above and yet has a reduce height and profile to permit access to spaces with limited clearance between the surface to be cleaned and overhead obstacles that may restrict available clearance.

These and other objects features and advantages of the present invention are provided by the use of traditional cleaning accessories to be attached to the elongate wand by a connector enabling cleaning of surfaces in both a horizontal and vertical plane relative to the elongate wand.

SUMMARY OF THE INVENTION

The present invention is illustrated by way of example in the attached drawings and includes a cleaning accessory adapted to be connected to an elongate wand of a traditional vacuum cleaner assembly and includes a connector shaped as an elbow and having structures at one end to secure the end of the connector to the free end of an elongate wand of a vacuum cleaner assembly in a manner to be pivotal in a first plane, and structures at the other end to secure this end of the connector to the cleaning element in a manner to be pivotal in essentially orthogonally to the first plane.

DETAILED DESCRIPTION OF PREFERRED EMBODIMENTS

Figure 1:
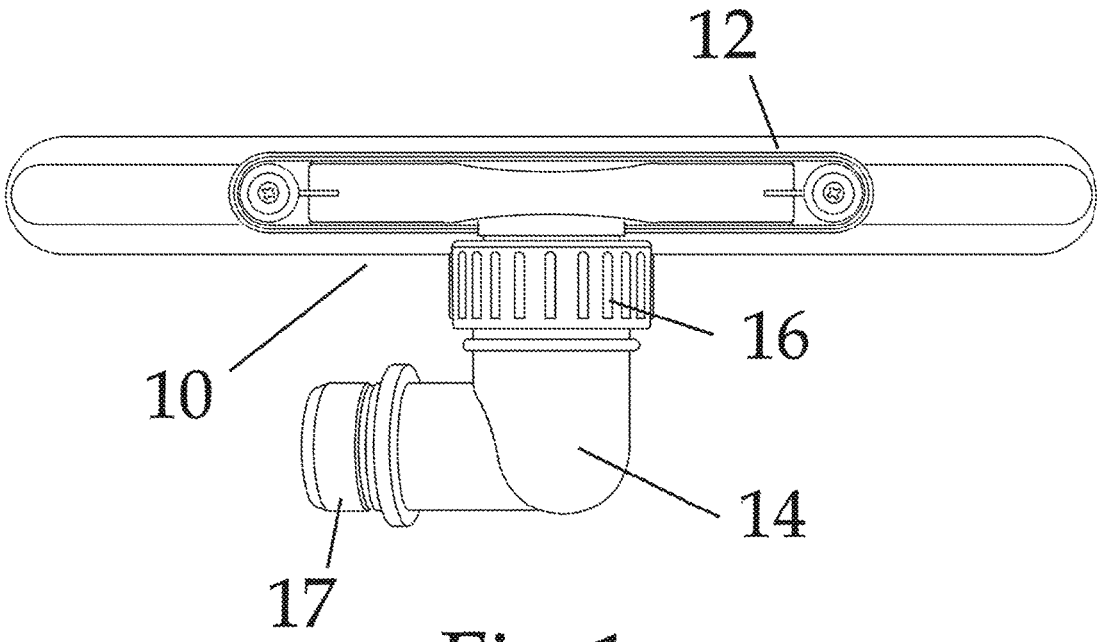
FIG. 1 illustrates a perspective view of one embodiment of the cleaning accessory of the present invention attached to one end of the elbow connector.
Figure 3:
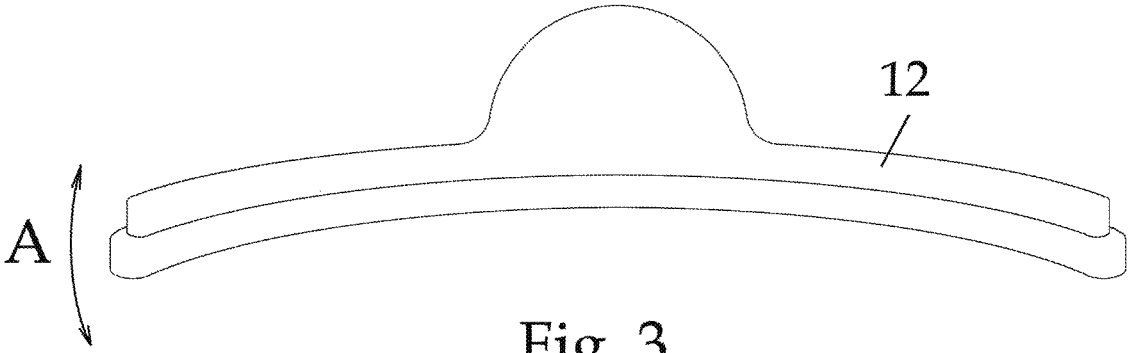
FIG. 3 illustrates a side view of the cleaning tool of FIGS. 1 and 2.
Figure 4A:
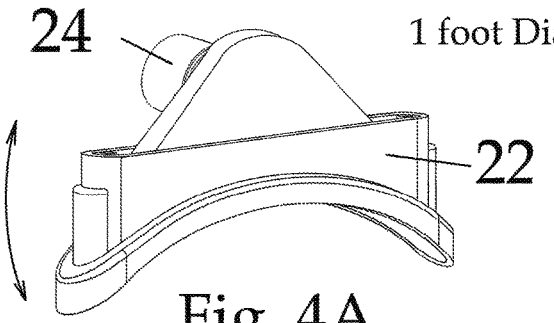
FIG. 4A through FIG. 4D illustrate alternate embodiments of the cleaning accessory.
Figure 4B:
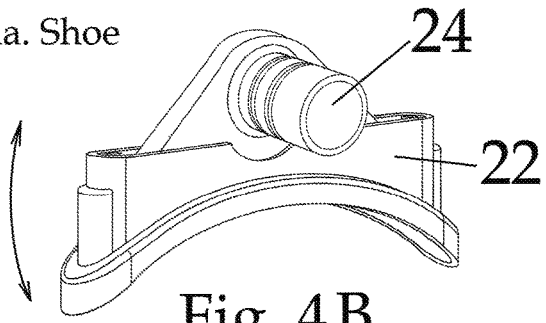
Figure 4C:
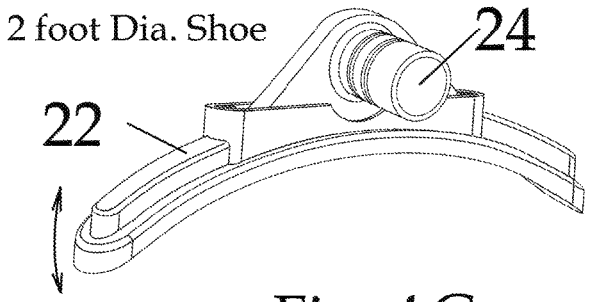
Figure 4D:
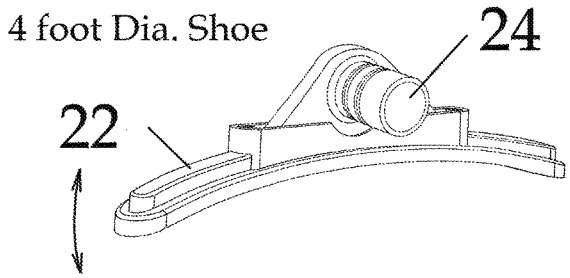
Figure 6:
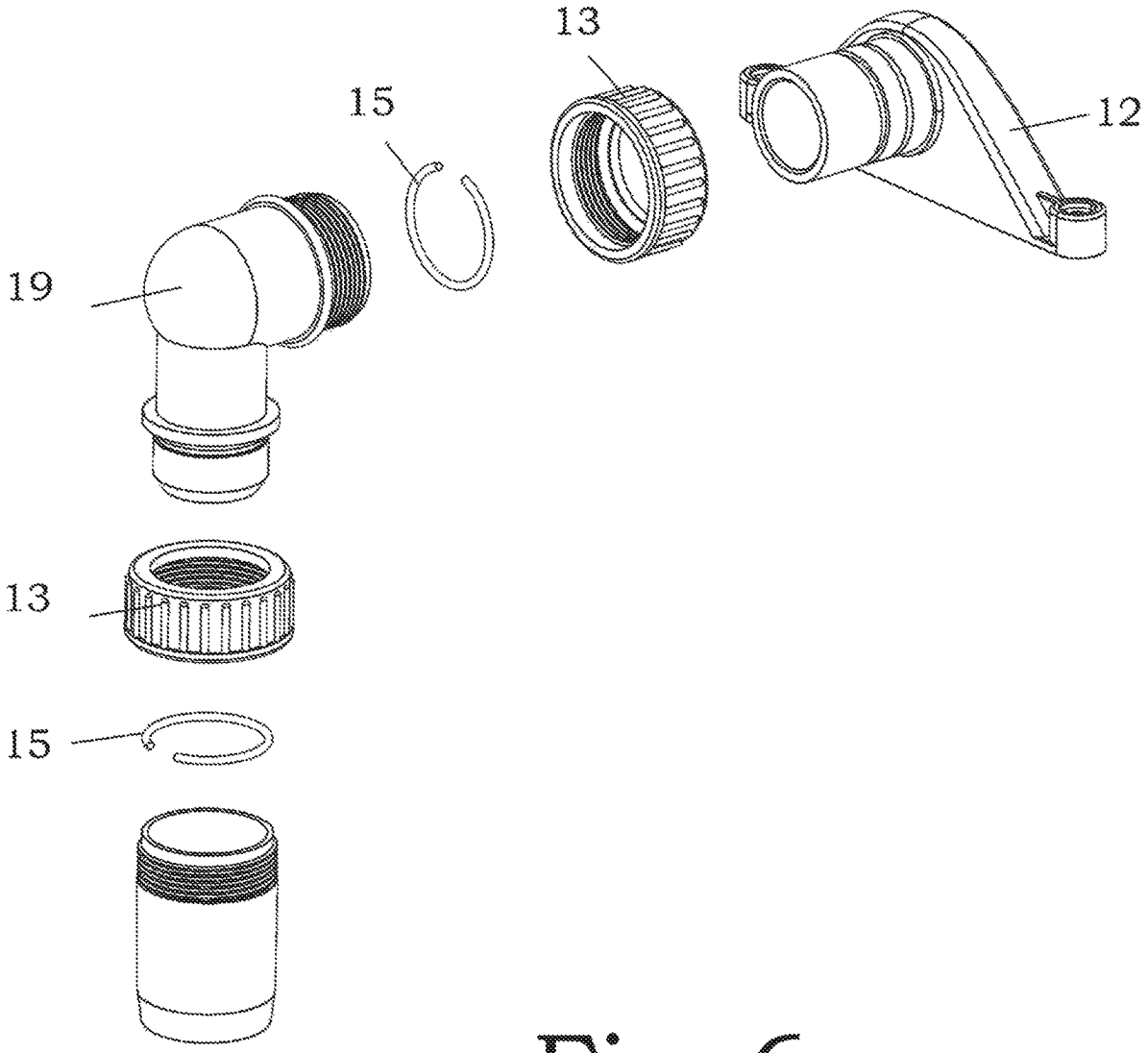
FIG. 6 illustrates the connections providing the pivotal movement.

As illustrated in FIG. 1, a cleaning accessory 10 of the present invention includes a cleaning element 12 shown as a conventional brush element that is connected to an elbow connector 14 having essentially a 90 degree bend. The connection at one end 16 of the elbow connector 14 to the cleaning element 12 includes structures to enable cleaning element 12 to pivot in the plane illustrated by the arrows A in FIG. 3. Such structures could include a frictional slide fitting or, as illustrated in FIG. 6, a threaded connection to a compression locking nut 13 and ring 15 that will enable the pivotal movement as illustrated in FIG. 3. The elbow is preferably formed of three pieces, a molded plastic or metal tube 19, a molded plastic or metal threaded nut 13, and a curved wire compression ring 15. One end is designed to engage cleaning wand 20 of a vacuum cleaning system creating a profile connection that does not add significantly to assembly height. The present invention, however, includes any structures providing the pivot movement illustrated in FIG. 3.

Figure 2:
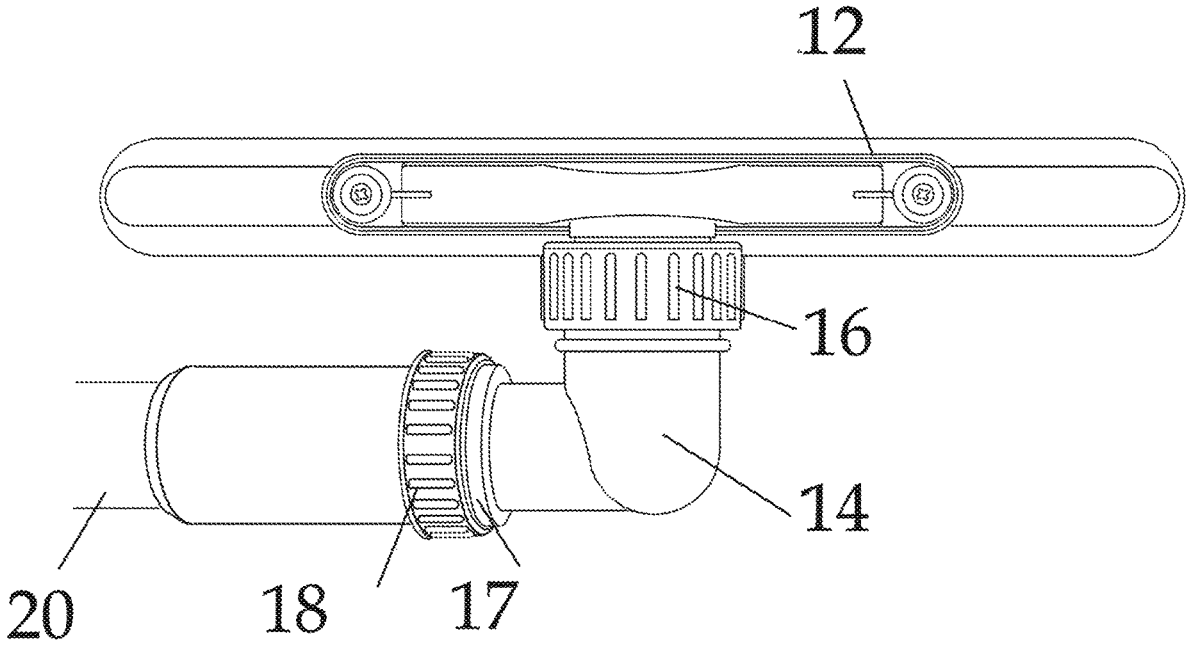
FIG. 2 illustrates a perspective view of the embodiment of FIG. 1 including the structures for attachment of the other end of the elbow connector to the elongate wand of a vacuum cleaner.

FIG. 2 illustrates the other end 17 of the elbow connector 14 connected by structures 18 to the free end of an elongate wand 20 of a vacuum cleaner system providing suction to the cleaning element and elbow connector. The structures 18 attaching the elbow connector 14 to the wand 20 enable the elbow connector 14 to pivot essentially in a plane orthogonal to the plane illustrated by the arrows A in FIG. 3; this plane allowing the other end 17 of the elbow connector 14 being able to rotate around the axis of the junction of the end 17 and the elongate wand 20. Such structures could include a frictional slide fitting or a threaded connection to a compression locking nut and ring as shown in FIG. 6 that will enable the required pivotal movement; or structures providing comparable movement.

Such structures as exemplified in FIGS. 1 through 3 enable a low profile for the cleaning assembly and yet allow the cleaning assembly to be pivoted in orthogonal planes relative the cleaning wand 20 to accomplish the objectives of the present invention.

And as an additional feature of the present invention, the pivotal connections provided by the compression locking nut 13 and ring 15 allow the tension and range of the pivotal movement to be adjusted as desired; or the locking nut can be tightened to lock in and secure a desired orientation and position of the cleaning element 12.

FIGS. 4A through 4D illustrate alternate embodiments of the cleaning element as labeled in differing dimensions. Such alternate embodiments include a shoe 22 of various configurations connected by a pivotal connection at end portion 24 enabling the shoe 22 to pivot in its plane. As can be understood by one skilled in the field, end portion 24 would be connected to an elbow connector such as elbow connector 14 for connection to a cleaning wand of a vacuum cleaning system.

Figure 5:
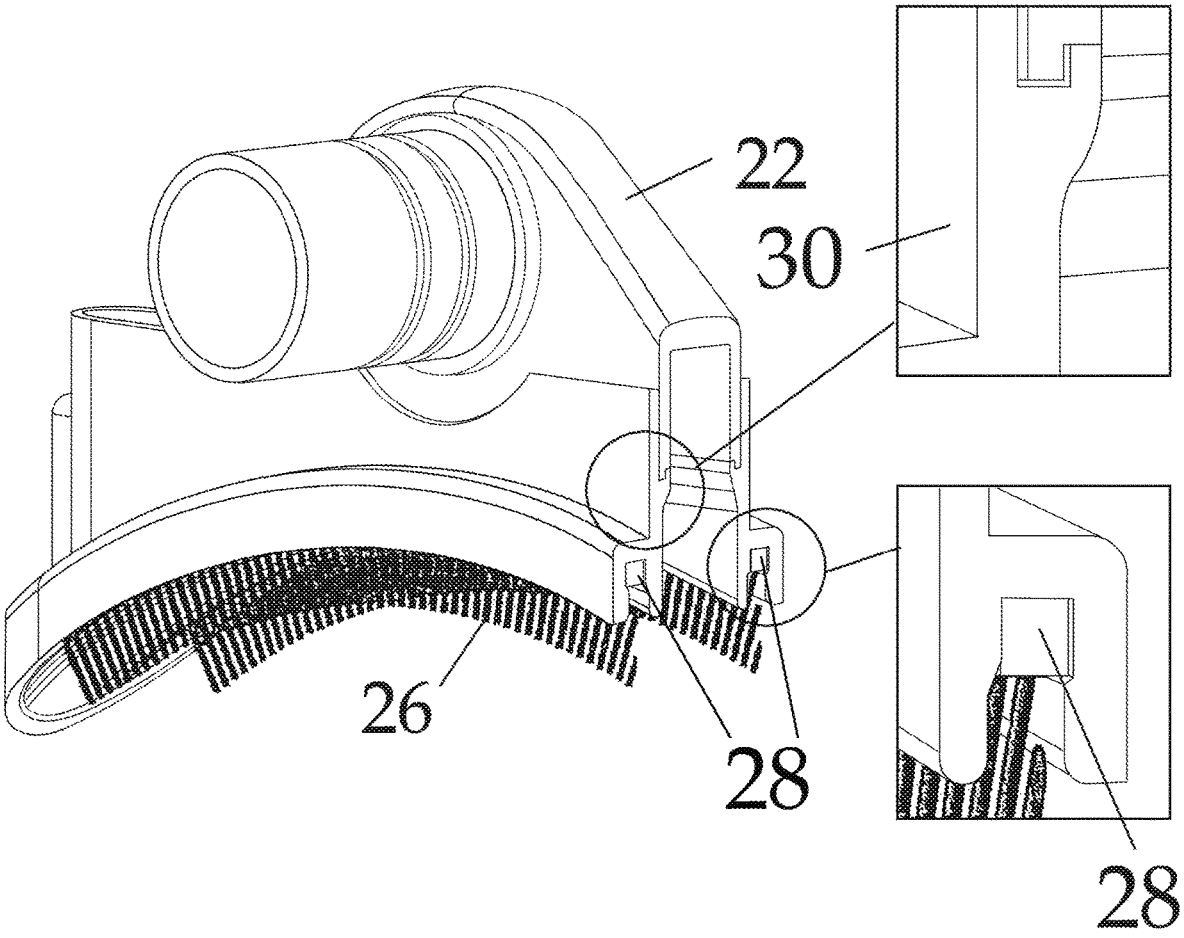
FIG. 5 illustrates another embodiment of the cleaning accessory.

FIG. 5 illustrates an example of how a cleaning brush 26 could be attached removably to a shoe 22 by being press fitted into supporting groove 28 in a brush holder that is itself is connected to shoe 22 by a press fitted insertion 30 as shown.

The present invention is not intended to be limited by any of the details describe above, and is defined by the appended claims.

What is claimed is:

1. A cleaning accessory adapted to be connected to an elongate wand of a vacuum cleaner assembly, includes a connector shaped as an elbow and having structures at one end adapted to secure the end of the connector to the free end of an elongate wand of a vacuum cleaner assembly in a manner to be pivoted in a first plane, and structures at the other end adapted to secure said other end of the connector to the cleaning element in a manner essentially orthogonal to the first plane.

2. A connector for a cleaning accessory adapted to connect a cleaning element to an elongate wand of a vacuum cleaner assembly, said connector being shaped as an elbow and having structures at one end adapted to engage one end of the connector to the free end of an elongate wand of a vacuum cleaner assembly in a manner to be pivoted in a first plane, and structures at the other end adapted to engage said other end of the connector to the cleaning element in a manner essentially orthogonal to the first plane.

* * * * *